US007794267B2

(12) United States Patent
Daily

(10) Patent No.: US 7,794,267 B2
(45) Date of Patent: Sep. 14, 2010

(54) CARD EDGE CONNECTOR WITH IDC WIRE TERMINATION

(75) Inventor: Christopher George Daily, Harrisburg, PA (US)

(73) Assignee: Tyco Electronics Corporation, Berwyn, PA (US)

( * ) Notice: Subject to any disclaimer, the term of this patent is extended or adjusted under 35 U.S.C. 154(b) by 93 days.

(21) Appl. No.: 12/186,926

(22) Filed: Aug. 6, 2008

(65) Prior Publication Data

US 2010/0035443 A1 Feb. 11, 2010

(51) Int. Cl.
*H01R 4/24* (2006.01)

(52) U.S. Cl. ..... 439/409; 439/402

(58) Field of Classification Search ..... 439/409, 439/410, 402, 701, 141, 717, 595
See application file for complete search history.

(56) References Cited

U.S. PATENT DOCUMENTS

| | | | | | |
|---|---|---|---|---|---|
| 3,771,104 | A * | 11/1973 | Clark | ..... | 439/415 |
| 4,425,018 | A * | 1/1984 | Stenz | ..... | 439/716 |
| 4,469,393 | A * | 9/1984 | Chewning et al. | ..... | 439/717 |
| 5,605,469 | A * | 2/1997 | Wellinsky et al. | ..... | 439/417 |
| 5,904,598 | A * | 5/1999 | Yamanashi | ..... | 439/701 |
| 5,938,479 | A * | 8/1999 | Paulson et al. | ..... | 439/676 |
| 5,967,826 | A * | 10/1999 | Letailleur | ..... | 439/402 |
| 6,080,006 | A * | 6/2000 | Broder | ..... | 439/409 |
| 6,152,760 | A * | 11/2000 | Reeser | ..... | 439/409 |
| 6,159,036 | A | 12/2000 | Daoud | | |
| 6,165,003 | A | 12/2000 | Bigotto | | |
| 6,168,478 | B1 | 1/2001 | Daoud | | |
| 6,193,550 | B1 * | 2/2001 | Yamashita et al. | ..... | 439/594 |
| 6,254,421 | B1 * | 7/2001 | Denovich et al. | ..... | 439/409 |
| 6,296,515 | B1 | 10/2001 | Daoud | | |
| 6,332,813 | B1 * | 12/2001 | Okabe et al. | ..... | 439/701 |

(Continued)

FOREIGN PATENT DOCUMENTS

DE 199 45 412 3/2000

(Continued)

OTHER PUBLICATIONS

Tyco Electronics, "Eurostyle Terminal Blocks Focus Product Stock List", (c) 2008 by Tyco Electronics Corporation, Harrisburg, PA.

(Continued)

*Primary Examiner*—T C Patel
*Assistant Examiner*—Harshad C Patel

(57) ABSTRACT

A card edge connector and a card edge assembly that utilizes the individual card end connectors are disclosed. The card edge connectors have slotted insulation displacement terminals to connect to wires. Each electrical connector has a housing with first mounting project extends from a first sidewall of the housing and a mounting recess extends from an oppositely facing second sidewall. The mounting projection is dimensioned to be received in the mounting recess of a second electrical connector, thereby allowing the connectors to be mounted to each other. This type of connector assembly allows the connector assembly to be built according to the needs of the end user. This modular aspect of the connector assembly adds flexibility while reducing the overall cost of manufacture. In addition, the use of the slotted insulation displacement terminals further enhances the flexibility of the connector assembly, as various wiring schemes can be effectively and cost efficiently utilized.

19 Claims, 6 Drawing Sheets

U.S. PATENT DOCUMENTS

| | | | | |
|---|---|---|---|---|
| 6,406,324 | B1 * | 6/2002 | Duesterhoeft et al. | 439/409 |
| 6,508,661 | B1 * | 1/2003 | Yu | 439/495 |
| 6,881,100 | B2 * | 4/2005 | Barry et al. | 439/701 |
| 6,884,106 | B2 * | 4/2005 | Shuman et al. | 439/358 |
| 6,953,351 | B2 * | 10/2005 | Fromm et al. | 439/101 |
| 7,144,269 | B2 * | 12/2006 | Libby et al. | 439/409 |
| 7,195,513 | B1 * | 3/2007 | Gherardini et al. | 439/401 |
| 7,347,718 | B2 | 3/2008 | Donhauser et al. | |
| 7,357,661 | B2 | 4/2008 | Yamamoto et al. | |
| 2004/0058572 | A1 * | 3/2004 | Fromm et al. | 439/101 |
| 2007/0020997 | A1 * | 1/2007 | Miyakawa | 439/595 |

FOREIGN PATENT DOCUMENTS

| | | |
|---|---|---|
| EP | 0 405 630 | 1/1991 |
| FR | 2 730 096 | 8/1996 |

OTHER PUBLICATIONS

Blueprint of Tyco Electronics Part No. 1776282-2 [Pivot Block Assembly].

International Search Report, International Application No. PCT/US2009/004509.

* cited by examiner

CARD EDGE CONNECTOR WITH IDC WIRE TERMINATION

FIELD OF THE INVENTION

The present invention is directed to a card edge insulation displacement connector. More particularly, the present invention is directed to a card edge insulation displacement connector that has dual slotted terminals and which can be combined to form a card edge connector assembly.

BACKGROUND OF THE INVENTION

With the decreasing size of electronic devices used in most all fields, there is a continuing demand for smaller sized electrical components used in these electronic devices. This is especially so in the telecommunications field with the demand for mobile, lightweight and smaller sized devices. Similarly, in the field of cable communications, smaller sized electronic devices and the related connectors are in demand. For example, the household use of cable communications, both for television and computer connections, is one area where the need for smaller sized and reliable connectors is rapidly expanding.

In the telecommunications field, and more specifically in the cable communications field, insulation displacement contacts (IDCs) are used to quickly and reliably connect wires to a printed circuit board, a junction or distribution box or other devices. The IDC allows the user to connect the wire without the need for first removing the insulation from the wire end. That is, the IDC cuts through the insulation, when the wire is seated in the IDC, to make electrical connection. This ease of making wire connections, especially out in the field, makes the IDC a very useful component.

Example prior art IDCs include those disclosed in U.S. Pat. No. 6,168,478 B1, for a Snap Type Retention Mechanism For Connector Terminals issued to Daoud; U.S. Pat. No. 6,159,036, for a Locking Latch Mechanism For An Insulation Displacement Connector, also issued to Daoud; and U.S. Pat. No. 6,165,003, for an Electrical Connector With Variable Thickness Insulation-Piercing Contact Member issued to Bigotto. As shown and described in each of these patents, the IDC generally has a conducting terminal with a pair of beams such that when the wire and insulation is forced between the beams and the beams' edges cut through the wire insulation and make electrical contact with the wire.

Other example prior art IDCs are shown in U.S. Pat. Nos. 6,152,760 and 6,406,324 B1. The devices are an IDCs having pivoting wire stuffer elements or wire stuffers. The wire stuffers each have wire slots and are pivotable over the IDC terminal beams. With the wire stuffer in an open position, the wire (not shown) may be placed into the wire slot. When the wire stuffer is then forced into the closed position, with the wire in the wire stuffer slot, the terminal beams cut through the wire insulation and the wire is electrically connected to the terminal. The wire slot diameter is fabricated to accept a limited range of wire sizes. In the telecommunications field, the wire gauge may be between 22 AWG and 26 AWG.

While IDCs are very useful, IDC technology has been limited on printed circuit board for use with connectors that employ traditional through hole mount or surface mount technology. In a typical configuration with the IDC assembled on a circuit board, the pivotable wire stuffers tend to be difficult to operate without damaging other components, particularly when the circuit board has closely spaced components due to space requirements. Ease of use of this type of IDC would be greatly enhanced if the pivoting wire stuffers could be positioned at the edge of the circuit board. In addition, the positioning of the IDC connector on the edge of the circuit board would provide increased utilization of the circuit board, allowing other components to be mounted on the top and bottom surfaces thereof.

Accordingly, there remains a need for an IDC connector which can be mounted on the circuit board edge surface, thereby allowing for ease of assembly of the IDC connector to the circuit board and ease of termination of the wires in the IDC connector. Additionally, as space on the surface of the printed circuit board is many times at a premium, mounting the IDC connector on the edge of the circuit board allows other component to be mounted on the surface of the printed circuit board in the space previously occupied by the IDC connector and provides for a separable and distinct interface, removed from the components mounted on the face of the printed circuit board.

SUMMARY OF THE INVENTION

The invention is directed to a card edge connector which is connected to an edge of a circuit board and which also uses insulation displacement terminals to connect to wires. The card edge connector has a housing with a wire receiving face and a board receiving face. Terminal receiving cavities extend from proximate the wire receiving face toward the board receiving face. A board receiving slot extends from the board receiving face toward the terminal receiving face. Terminals are positioned in the terminal receiving cavities. The terminals have insulation displacement sections proximate the wire receiving face and board engagement sections that extend from the terminal receiving cavities into the board receiving slot. The board receiving slot is dimensioned to receive an edge of circuit board therein. The terminals may have insulation displacement slots provided thereon, which can allow two or more wires to be terminated to respective insulation displacement slots thereby allowing for special wire schemes.

The card edge connector may also include a wire stuffer cap movably mounted to the housing. The wire stuffer cap may initially be provided in an open position to allow wire to be inserted into the wire stuffer cap. The wire stuffer cap may be moved to a second position, which forces the wires into respective insulation displacement slots, causing the wires and the terminals to be placed in electrical engagement.

The invention is also directed to an electrical connector that has a housing and terminals positioned in terminal receiving cavities of the housing. The housing has first mating face and a second mating face. A first mounting project extends from a first sidewall of the housing and a mounting recess extends from an oppositely facing second sidewall. The mounting projection is dimensioned to be received in the mounting recess of a second electrical connector, thereby allowing the connectors to be mounted to each other. The first mounting projection may have an upper wall and a lower wall; the upper wall and the lower wall are sloped toward each other as the upper and lower walls near the first sidewall. The mounting recess has second mounting projections that define the mounting recess. The second mounting projections have sloped walls adjacent the mounting recess, the sloped walls slope away from each other as the sloped walls near the second sidewall. The first mounting projection of the card edge connector is configured to be moved into a mounting recess of a respective second card edge connector, such that the upper wall and the lower wall of the first mounting projection cooperate with the sloped walls of the second mounting projections to retain the first mounting projection of the card edge connector in a respective mounting recess of the respective second card edge connector.

The invention is also directed to an electrical connector assembly which has at least two electrical connectors that are connected together to form the assembly. The connectors have housings with first mating faces, second mating faces, and terminal receiving cavities that extend from proximate the first mating faces toward the second mating faces. First mounting projections extend from first sidewalls of the housings and mounting recesses are provided on oppositely facing second sidewalls. The mounting projection of one electrical connector is positioned in the mounting recess of a second electrical connector, the first mounting projection and the mounting recess cooperate to maintain the electrical connectors in position relative to each other, thereby forming the electrical connector assembly.

This type of connector assembly allows the connector assembly to be built according to the needs of the end user. As electrical connectors can be mounted together to form any length connector assembly, only one type and size of electrical connector needs to be tooled and manufactured. This modular aspect of the connector assembly adds flexibility while reducing the overall cost of manufacture. The use of card edge connectors that utilize insulation displacement termination methods is also advantageous. As board space is always at a premium, the ability to terminate wires to a connector mounted at the edge of a circuit board has significant cost savings, as a smaller board can be used without effecting the operation of the components. In addition, the use of dual slotted insulation displacement terminals further enhances the flexibility of the connector assembly, as various wiring schemes can be effectively and cost efficiently utilized.

Other features and advantages of the present invention will be apparent from the following more detailed description of the preferred embodiment, taken in conjunction with the accompanying drawings which illustrate, by way of example, the principles of the invention.

DETAILED DESCRIPTION OF THE INVENTION

Figure 1:
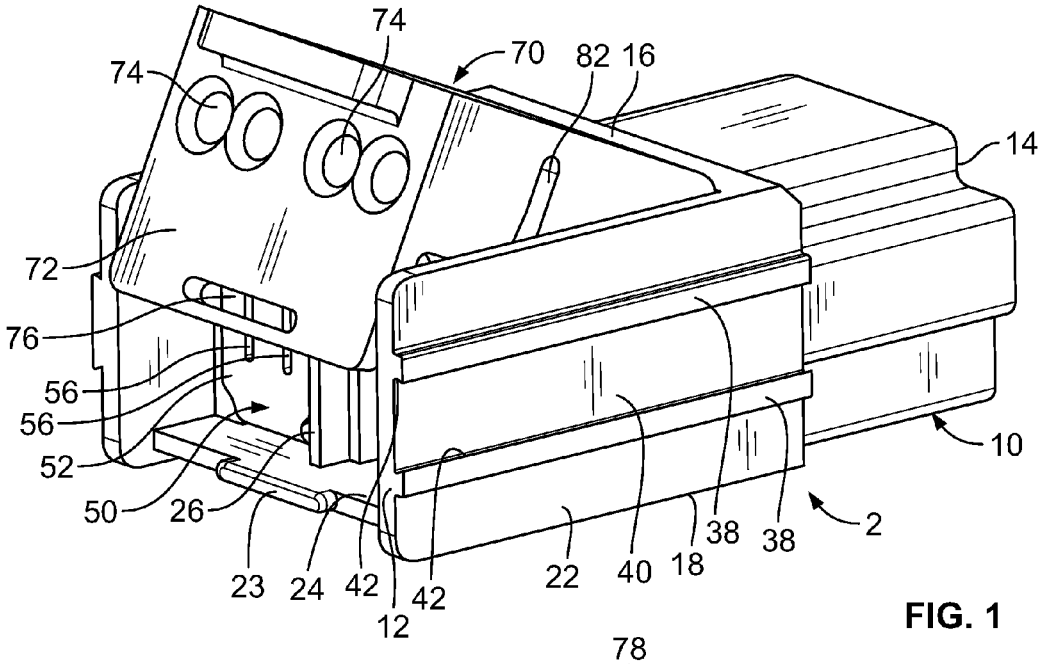
FIG. 1 is a front perspective view of a card edge connector with a stuffer cap in an open position according to the present invention.
Figure 3:
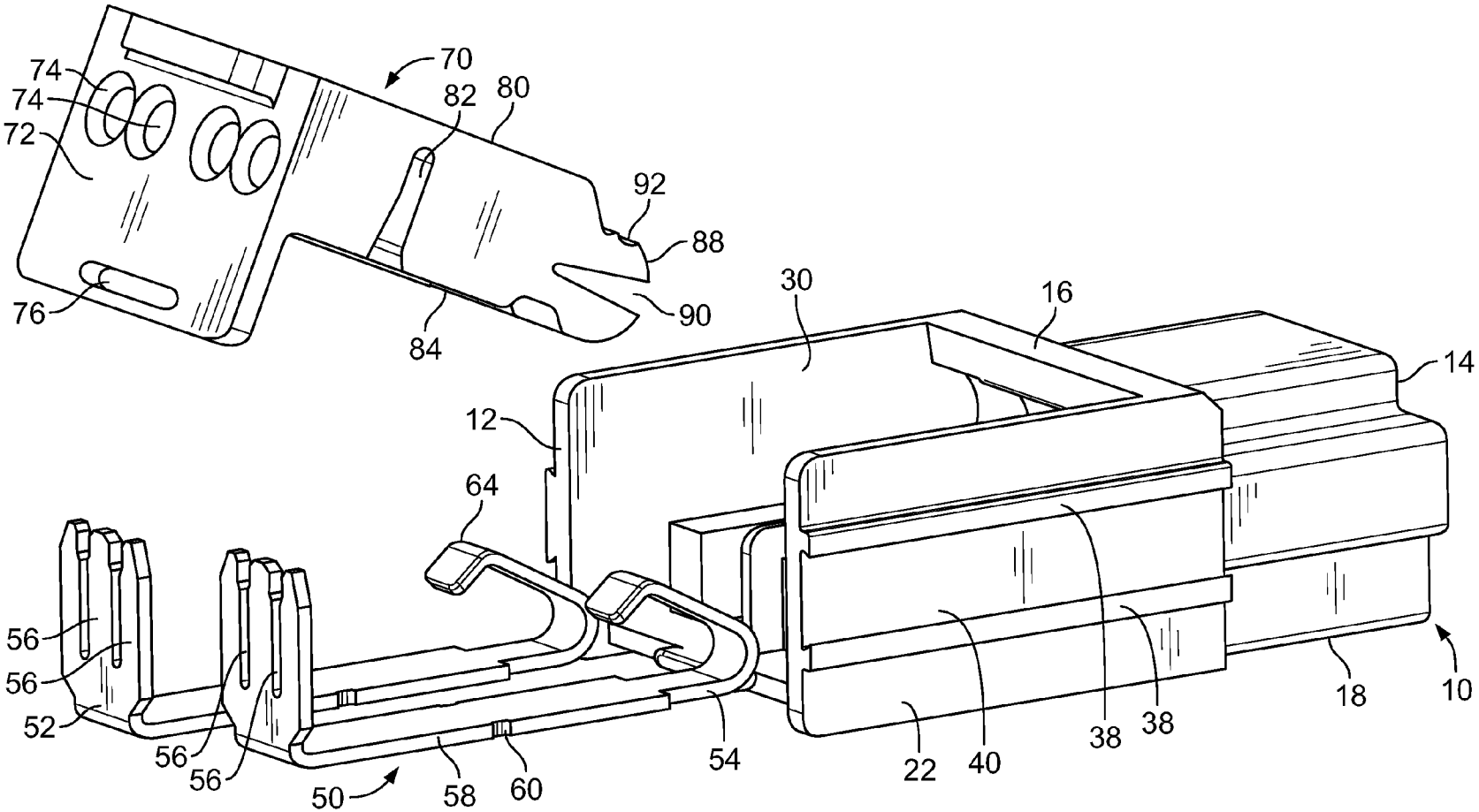
FIG. 3 is a front perspective view of the card edge connector with terminals and the stuffer cap exploded therefrom.

As shown in FIGS. 1 and 3, a card edge connector 2 has a housing 10, terminals 50 and a stuffer cap 70. While the embodiment shown has two terminals 50 and one stuffer cap 70 installed in the housing 10, other size housings with different numbers of terminals and different size and numbers of stuffer caps can be substituted without departing from the scope of the invention.

Figure 7:
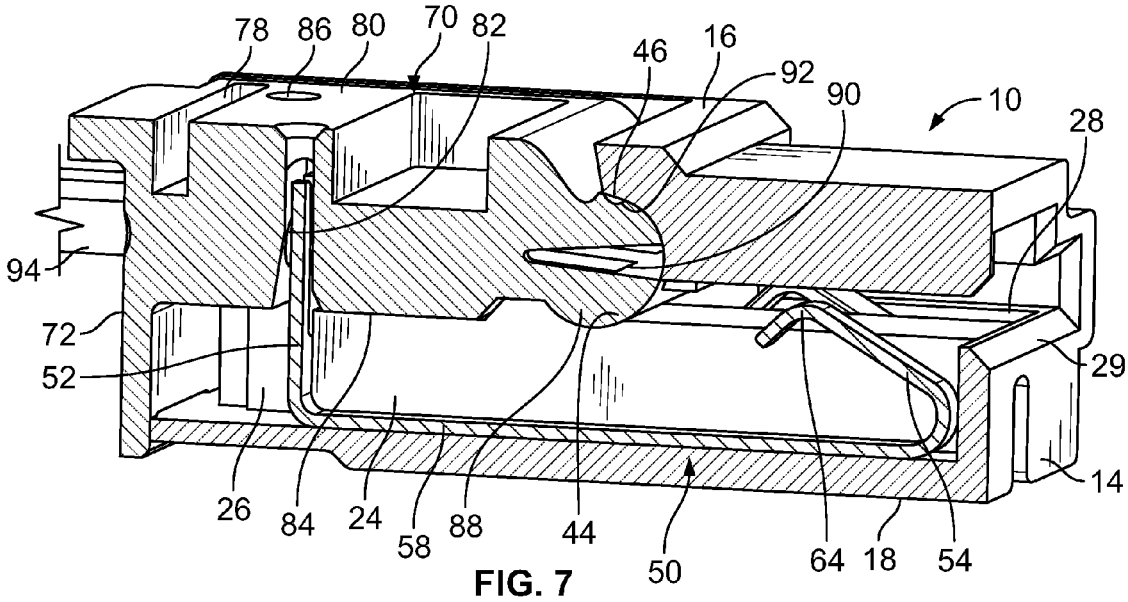
FIG. 7 is a cross-sectional perspective view of the card edge connector with the wires terminated therein.
Figure 8:
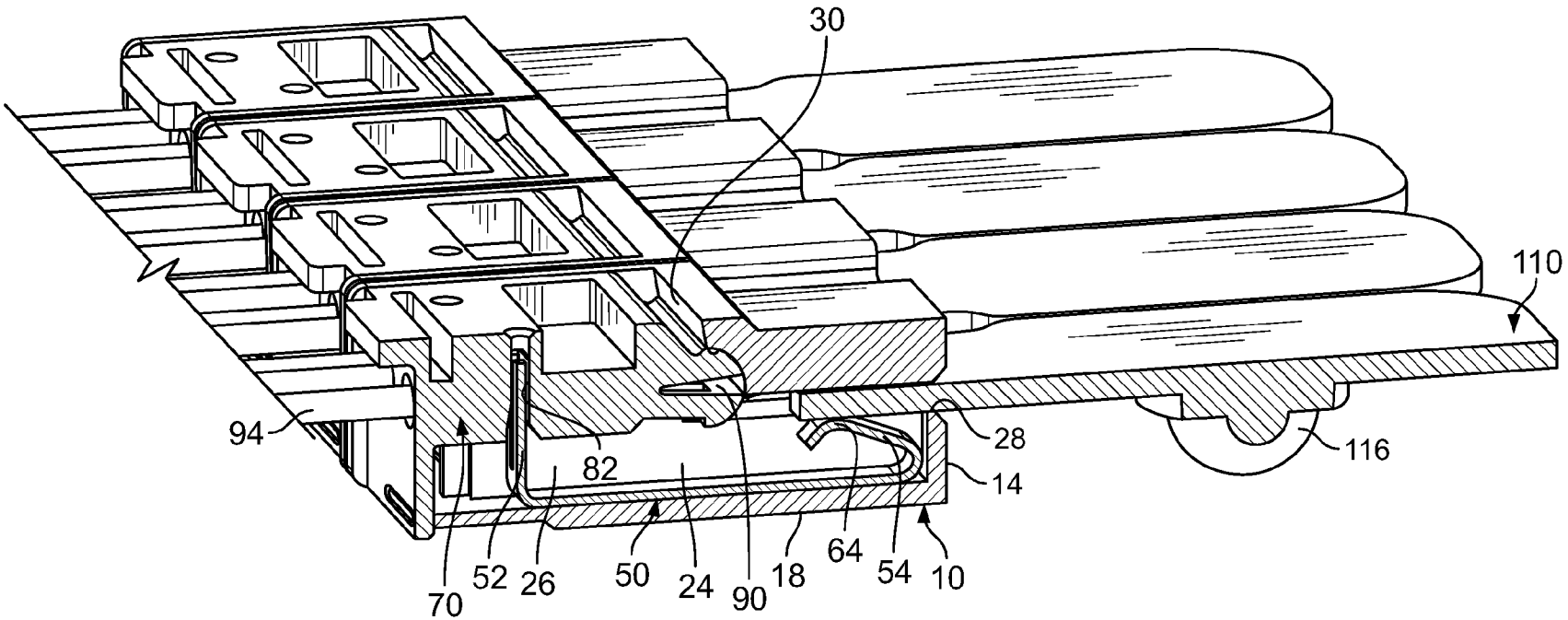
FIG. 8 is a cross-sectional perspective view of the card edge connector with the wires and circuit board terminated therein

Housing 10 is made of plastic or other similar material that is nonconductive and has the strength and moldability characteristics required. Housing 10 has a wire receiving face 12, a card or circuit board receiving face 14. Top wall 16, bottom wall 18, sidewall 20 and sidewall 22 extend between the wire receiving face 12 and the board receiving face 14. A latching projection 23 extends from the wire receiving face 12. Terminal receiving cavities 24 (FIGS. 7 and 8) extend from the wire receiving face 12 toward the board receiving face 14. As shown in FIGS. 1, 3, 7 and 8, a dividing wall 26 is positioned between the terminal receiving cavities 24. Referring to FIGS. 7 and 8, a card or board receiving slot 28 extends from the board receiving face 14 towards the wire receiving face 12. The board receiving slot 28 extends from proximate the sidewall 20 to proximate the sidewall 22. A cap receiving cavity 30 (FIG. 3) extends from the wire receiving face 12 toward the board receiving face 14 and from the top wall 16 to the terminal receiving cavities 24. A pivot cavity 44 is provided proximate the cap receiving cavity 30. The pivot cavity 44 has a seating projection or lip 46 which extends therein.

Figure 4:
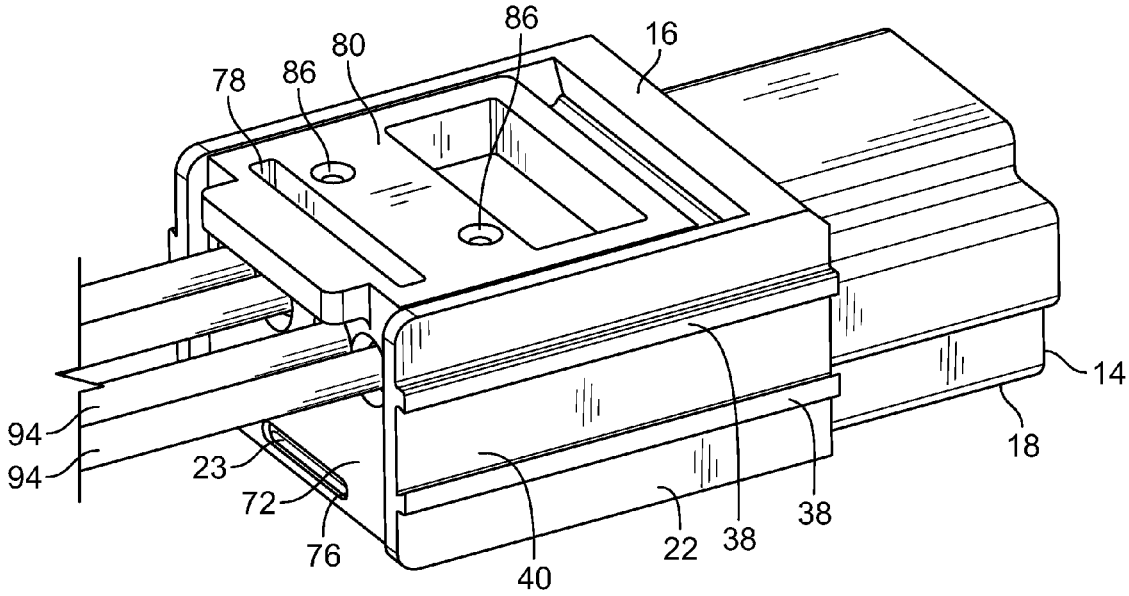
FIG. 4 is a front perspective view of the card edge connector with wires terminated thereto and the stuffer cap in a closed position.
Figure 9:
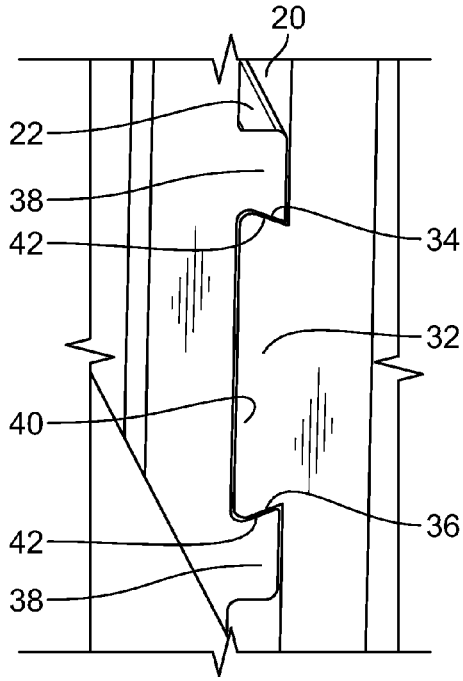
FIG. 9 is an enlarged front view of a mating portion of two card edge connectors.

As best shown in FIGS. 4 and 9, sidewall 20 has an elongate first mounting projection 32 which is essentially parallel to the bottom wall 18 and which extends from proximate the wire receiving face 12 toward the board receiving face 14. The first mounting projection 32 has an upper wall 34 (FIG. 9) and a lower wall 36 which are sloped toward each other as the walls 34, 36 near the sidewall 20. This shape of the first mounting projection 32 is generally referred to as a dovetail in the wood working industry. Sidewall 22 has two elongate second mounting projections 38 that are also essentially parallel to the bottom wall 18 and which extend from proximate the wire receiving face 12 toward the board receiving face 14. The second mounting projections 38 form a mounting recess 40 therebetween for receiving a corresponding first mounting projection 32 therein, as will be more fully discussed below. The second mounting projections 38 have sloped internal walls 42 which are sloped away from each other as the walls 42 near the sidewall 22. While the dovetail type configuration is shown, other types of shapes and configurations of the first and second mounting projections can be used. For example, the first mounting projection may have arcuate surfaces on the upper wall and lower walls which cooperate with corresponding arcuate surfaces of the walls of the second mounting projections As best shown in FIG. 3, terminals 50 have insulation displacement sections 52 at one end and card or circuit board engagement sections 54 at the other end. In the embodiment shown, each insulation displacement section 52 has two slots 56 which extend inward from the ends of terminals 50. The slots 56 are dimensioned to cooperate with one or more wires 94 inserted therein. However, while two slots are shown, each insulation displacement section may have one, three, or any other number of slots depending upon the number of wires to be terminated to each terminal. Extending from insulation displacement sections 52 at essentially ninety degrees therefrom are mounting sections 58. Mounting sections 58 have retention barbs 60 which are dimensioned to engage and displace material of the housing 10 around the terminal receiving cavities 24 to create an interference fit to retain the mounting sections 58 and the terminals 50 in the terminal receiving cavities 24 of the housing 10. Circuit board engagement sections 54 extend from mounting sections 58 and are bent back toward the insulation displacement sections 52, such that circuit board engagement sections 54 have resilient characteristics. Contact sections 64 are provided on the circuit board engagement sections 54. The contact sections 64 extend from the terminal receiving cavities 24 into the board receiving slot 28.

The wire stuffer cap 70, as shown in FIGS. 1, 3 and 7, has a wire receiving face 72 through which wire receiving openings 74 extend. In the embodiment shown, four wire receiving openings 74 are provided to align with the four slots 56 (best shown in FIG. 3). A latching slot 76 extends through the wire receiving face 72 at a location removed from wire receiving openings 74. Referring to FIG. 7, a tool receiving slot 78 extends from a top surface 80 of the wire stuffer cap 70. The tool receiving slot 78 is dimensioned to receive a blade of a screwdriver or other similar device therein. As shown in FIGS. 1, 3 and 7, a terminal receiving slot 82 extends from bottom surface 84 toward top surface 80. The terminal receiving slot 82 is configured to receive and maintain the insulation displacement section 52 of the terminal 50 therein. A probe opening 86 extends from the top surface 80 to the terminal receiving slot 82. This allows a probe to be inserted into the terminal receiving slot 82 to test the electrical connection between the terminal 50 and wires 94. As shown in FIGS. 3 and 7, each wire stuffer cap 70 has a pivot seat 88 extending therefrom. In the embodiments shown, the pivot seats have a cylindrical configuration, but other configurations are possible. The pivot seat 88 has a slot 90 provided therein, the slot provides resiliency to either half of the pivot seat 88. A detent 92 is provided on the surface of the pivot seat 88.

Figure 2:
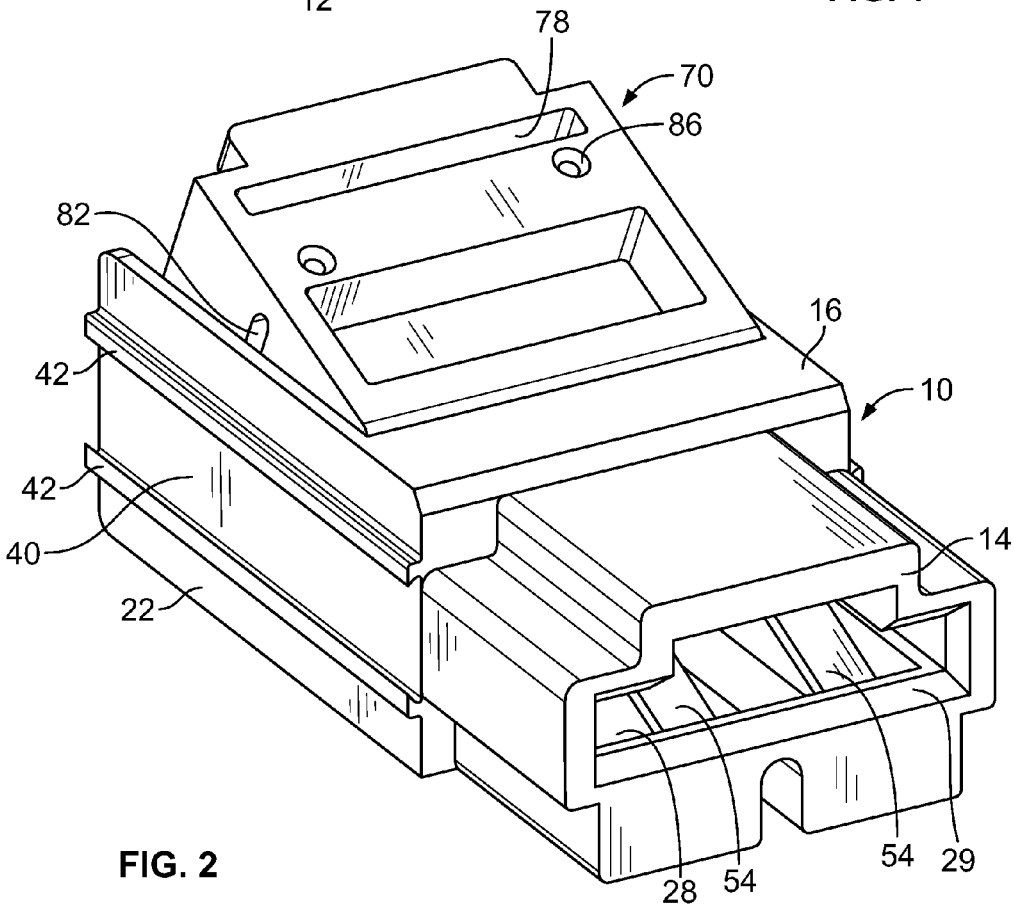
FIG. 2 is a back perspective view of the card edge connector of FIG. 1.

Referring to FIG. 1 and 2, the wire stuffer cap 70 is initially provided in an open or up position. In this position, the lip 46 is positioned in detent 92, thereby maintaining the wire stuffer cap 70 in the open position. As the detent 92 has engaged the lip 46, the wire stuffer cap 70 will remain in its open position until it is purposefully pushed down into the closed position (FIG. 7), thereby releasing the detent 92 from the lip 46. In the open position, wires 94 are inserted into wire receiving openings 74. The unstripped wires 94 are inserted into respective wire receiving openings 74 until the wires 94 engage stop projections. The stuffer cap 70 may be made of clear resin to allow for visual inspection of the inserted wires 94. The stuffer cap 70 is depressed, causing the pivot seat 88 to pivot in the pivot cavity 44, forcing the wires 94 down onto the insulation displacement sections 52 of the terminals 50, causing the wires 94 to move into slots 56 which results in the insulation 96 of the wires 94 being pierced, placing the conductors 98 of the wires 94 in electrical and mechanical engagement with the insulation displacement sections 52 of the terminals 50. The stuffer cap 70 can be moved by hand or by the work end of a screwdriver in cooperation with tool receiving slot 78 of stuffer cap 70. The wire termination is similar to that disclosed in U.S. Pat. No. 5,667,402, which is hereby incorporated by reference. The wire size or wire gauge that is capable of being accommodated by the card edge connector 2 extends from 16 AWG to 28 AWG.

For different applications, different configurations may be needed. For example, non-uniform wire stuffer caps may be necessary for specific wiring applications. Obviously varied configurations of the card edge connector 2 may be fabricated to include two or more wire stuffer caps 70 being coupled in the housing 10, and a varied number of wire receiving openings 74 being formed in each wire stuffer cap 70.

Wire stuffer cap 70 is maintained in the closed position by the insertion of latching projections 23 in latching slot 76. In this closed position, dividing wall 26 electrically and physically isolates the terminals 50 housed in the terminal receiving cavities 24. A probe (not shown) may be inserted into the probe openings 86 to test if a proper electrical connection is provided between the conductors 98 of wires 94 and the insulation displacement sections 52 of terminals 50. This allows each connection to be tested to determine if a problem exists, thereby preventing the needless movement of the wire stuffer cap 70 from the closed position.

Figure 5:
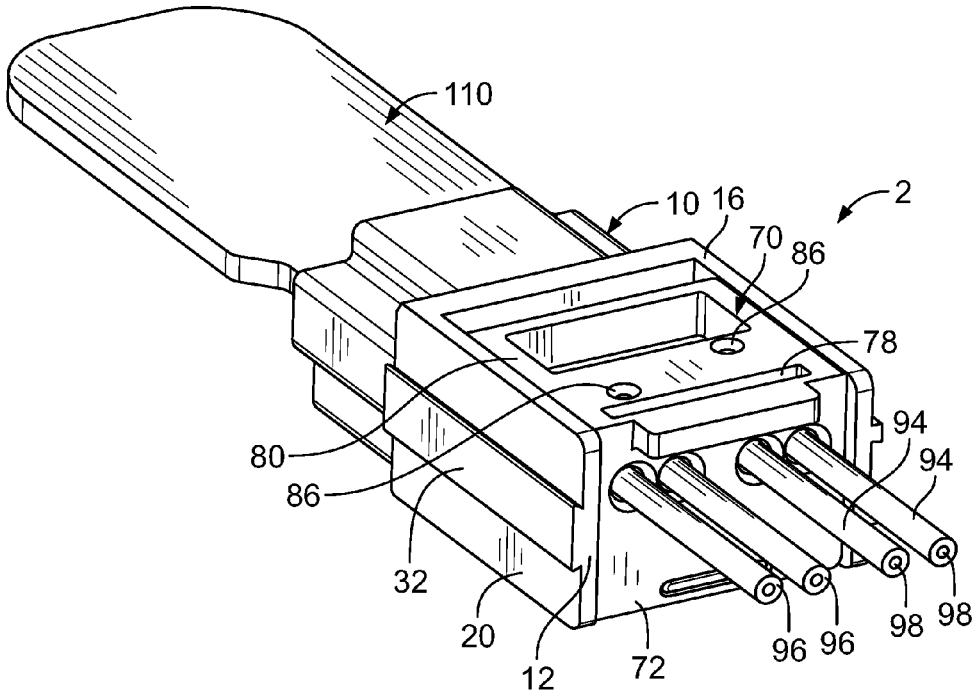
FIG. 5 is a front perspective view of the card edge connector with wires and a circuit board terminated thereto.
Figure 6:
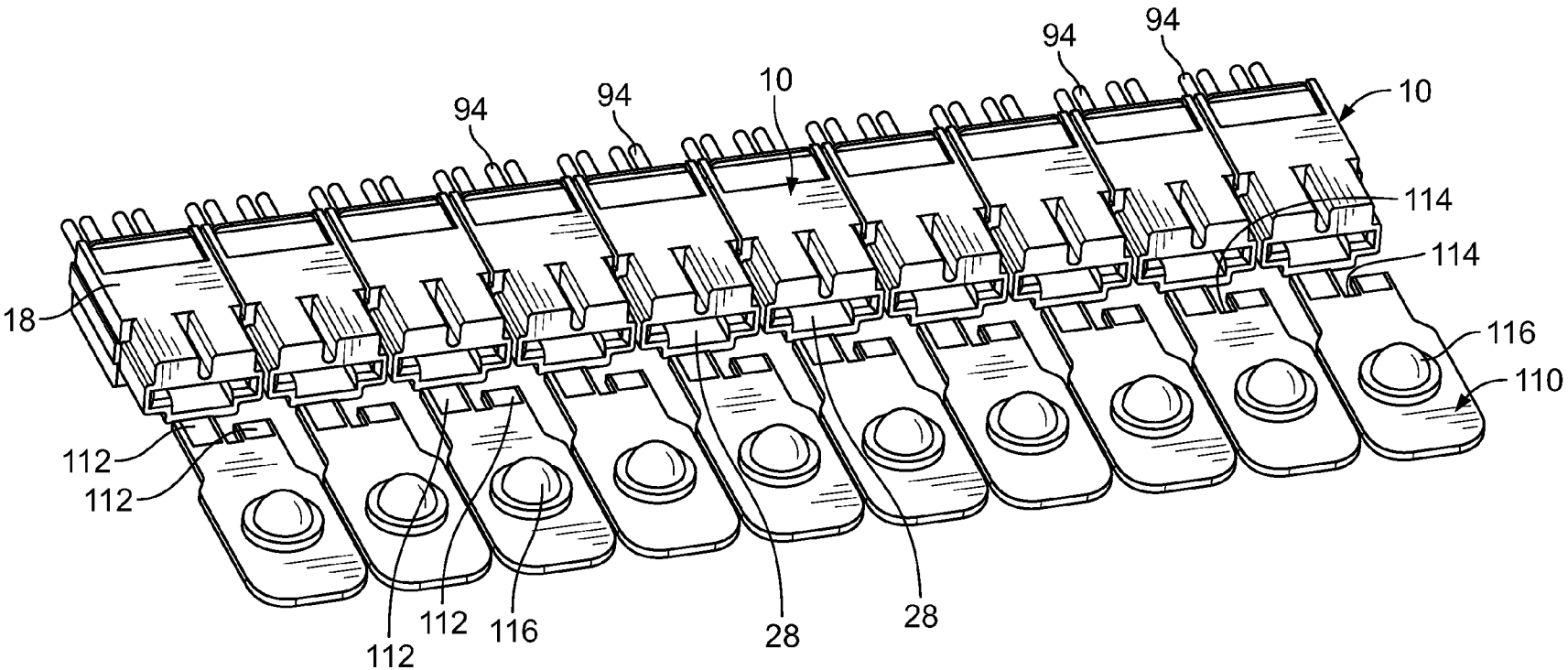
FIG. 6 is a bottom perspective view of a series of card edge connectors joined together prior to the insertion of the circuit boards therein.

As is shown in FIGS. 1, 4 and 5, two wires 94 are terminated to each terminal 50. The dual slots 56 of each terminal 50 allow for the terminals 50 and card edge connectors 2 to be connected in series, daisy chained, or connect using other special wiring schemes. This can be useful, particularly in applications, such as shown in FIG. 6, in which the card edge connectors 2 are stacked or are engaged to form an expandable assembly made from card edge connectors 2. As previously stated, the terminals may have a different number of slots depending on the application. In addition, different numbers of wires may be used depending upon the wiring scheme employed.

As best shown in FIGS. 6 and 8, a printed circuit card or board 110 can be inserted into the board receiving slot 28. A lead-in surface 29 of the board receiving slot 28 guides the circuit board 110 into the board receiving slot 28. As the circuit board 110 is inserted into the board receiving slot 28, the circuit board 110 engages the contact sections 64 of the circuit board engagement sections 54 of the terminals 50, causing the contact sections 64 and the circuit board engagement sections 54 to be resiliently displaced. Continuation of the insertion of the circuit board 110 continues until contact pads 112 positioned proximate the edge 114 of the circuit board 110 are placed in electrical and physical engagement with the contact sections 64 of the circuit board engagement sections 54, as shown in FIG. 8. In this position, the contact sections 64 are biased against the contact pads 112 to provide the required electrical connection. In addition, as the circuit board 110 is inserted, the biasing of the contact sections 64 of the circuit board engagement sections 54 causes the contact sections 64 to wipe across the circuit pads 112, thereby removing any contamination that may be present on the contact sections 64 or the circuit pads 112. The circuit board 110 may be metal clad (not shown) on the side of the circuit board opposite the side on which the circuit pads 112 are positioned. The use of a metal clad circuit board is effective with this card edge connector 2, as the contact sections 64 are positioned only on one side of the inserted circuit board 110. The use of a metal clad circuit board can be beneficial because of the heat dissipation properties thereof. Essentially the metal cladding acts as a heat sink, drawing heat away from the LEDs. As the metal cladding has a large surface area, the heat is dissipated from the metal cladding in a more efficient manner than the heat is dissipated directly from the LED.

In the fully inserted position, the resiliency of the contact sections 64 ensures that the contact sections 64 will remain in engagement with the contact pads 112, even if the circuit board 110 is slightly warped. Additionally, the circuit board 110 is maintained in the board receiving slot 28 by the biasing force exerted by the contact sections 64 on the circuit pads 112. Alternatively, other known board latching devices may be incorporated without departing from the scope of the invention. As shown in FIGS. 6 and 7, the contact sections 64 and the circuit pads 112 may be staggered to allow for easier insertion and to distribute the biasing forces applied by the contact sections 64 to different points on the circuit board 110, thereby preventing the circuit board 110 from pivoting relative to the card edge connector 2 when the circuit board 110 is fully mated to the card edge connector 2.

In the embodiment shown in FIG. 6, the circuit board 110 has LEDs 116 provided thereon. It is often desirable to "stack" the LEDs 116 in series, as shown in FIG. 6. As previously described, the dual slotted terminals 50 allow the wires 94 to be connected in series, facilitating this type of arrangement. In addition, respective first mounting projections 32 and second mounting projections 38 allow the card edge connectors 2 to be physically joined in series to form a large connector assembly. Referring to FIG. 9, a respective first mounting projection 32 of a first card edge connector 2 is slid into a respective mounting recess 40 of a second card edge connector 2. The card edge connectors 2 are offset along their longitudinal axis and are moved in the longitudinal direction such that the first mounting projection 32 is positioned in the mounting recess 40. In this position, walls 34, 36 of first mounting projection 32 engage walls 42 of second mounting projections 38. In so doing, the dovetail configuration prevents the card edge connectors 2 from being separated in a direction transverse to the longitudinal axis.

This type of card edge connector system allows for the tool free termination of the wires 94 and circuit boards 110. The small size of the card edge connectors 2, the stackability or modularity of the connectors and the use of the dual slotted terminals 50 allows the connectors to be arranged in multiple configurations according to the desired end use.

While the invention has been described with reference to a preferred embodiment, it will be understood by those skilled in the art that various changes may be made and equivalents may be substituted for elements thereof without departing from the scope of the invention. For example, different requirements for varied applications and installations often dictate different terminal configurations. The card edge connector may be configured to meet these different requirements through use of different terminal configurations. In addition, many modifications may be made to adapt a particular situation or material to the teachings of the invention without departing from the essential scope thereof. Therefore, it is intended that the invention not be limited to the particular embodiment disclosed as the best mode contemplated for carrying out this invention, but that the invention will include all embodiments falling within the scope of the appended claims.

The invention claimed is:

1. A card edge connector for electrically connecting wires to contact pads proximate an edge of a circuit board, the card edge connector comprising:

a housing having a wire receiving face and a board receiving face, terminal receiving cavities extending from proximate the wire receiving face toward the board receiving face, a board receiving slot extending from the board receiving face toward the terminal receiving face, the board receiving slot extends from the terminal receiving cavities and extends across more than one terminal receiving cavity;

terminals positioned in the terminal receiving cavities, the terminals having insulation displacement sections proximate the wire receiving face and board engagement sections, the board engagement sections extending from the terminal receiving cavities into the board receiving slot;

whereby the board receiving slot is dimensioned to receive the edge of circuit board therein, such that the board engagement sections are resiliently displaced as the circuit board is inserted into the board receiving slot, causing the board engagement sections to be biased against contact pads proximate the edge of the circuit board providing an electrical engagement between the board engagement sections and the contact pads.

2. A card edge connector as recited in claim 1 wherein each terminal has insulation displacement slots provided thereon, whereby multiple wires are terminated to respective insulation displacement slots to allow for special wire schemes.

3. A card edge connector as recited in claim 2 wherein a wire stuffer cap is movable mounted to the housing, the wire stuffer cap is initially provided in an open position, whereby as wires are inserted into the wire stuffer cap, the wire stuffer cap is moved to a second position, forcing the wires into respective insulation displacement slots thereby providing the wires and the terminals in electrical engagement.

4. A card edge connector as recited in claim 1 wherein the terminals have a mounting sections that provide an interference fit with the housing to maintain the terminals in the housing.

5. A card edge connector as recited in claim 1 wherein the housing has a first mounting projection extending from a first sidewall and a mounting recess provided on a second sidewall.

6. A card edge connector as recited in claim 5 wherein the first mounting projection has an upper wall and a lower wall, the upper wall and the lower wall are sloped toward each other as the upper and lower walls near the first sidewall.

7. A card edge connector as recited in claim 6 wherein the mounting recess has second mounting projections which define the mounting recess, the second mounting projections have sloped walls adjacent the mounting recess, the sloped walls slope away from each other as the sloped walls near the second sidewall.

8. A card edge connector as recited in claim 7 wherein the first mounting projection of the card edge connector is configured to be moved into a mounting recess of a respective second card edge connector, whereby the upper wall and the lower wall of the first mounting projection cooperate with the sloped walls of the second mounting projections to retain the first mounting projection of the card edge connector in a respective mounting recess of the respective second card edge connector.

9. A card edge connector for electrically connecting wires to contact pads proximate an edge of a circuit board, the connector comprising:

a housing having a first mating face and a second mating face, terminal receiving cavities extending from proximate the first mating face toward the second mating face, a board receiving slot extending from the second mating face toward the first mating face, the board receiving slot extends from the terminal receiving cavities and extends across more than one terminal receiving cavity, the board receiving slot is dimensioned to receive the edge of circuit board therein;

terminals positioned in the terminal receiving cavities, the terminals having first contact sections proximate the first mating face and second contact sections, the second contact sections extending from the terminal receiving cavities into the board receiving slot, such that the second contact sections are resiliently displaced as the circuit board is inserted into the board receiving slot, causing the second contact sections to be biased against contact pads proximate the edge of the circuit board, providing an electrical engagement between the second contact sections and the contact pads;

a first mounting project extending from a first sidewall of the housing and a mounting recess extending from an oppositely facing second sidewall;

whereby the mounting projection is dimensioned to be received in the mounting recess of a second electrical connector, allowing the connectors to be mounted to each other.

10. A card edge connector as recited in claim 9 wherein the first mounting projection has an upper wall and a lower wall, the upper wall and the lower wall are sloped toward each other as the upper and lower walls near the first sidewall.

11. A card edge connector as recited in claim 10 wherein the mounting recess has second mounting projections which define the mounting recess, the second mounting projections have sloped walls adjacent the mounting recess, the sloped walls slope away from each other as the sloped walls near the second sidewall.

12. A card edge connector as recited in claim 11 wherein the first mounting projection of the card edge connector is configured to be moved into a mounting recess of a respective second card edge connector, whereby the upper wall and the lower wall of the first mounting projection cooperate with the sloped walls of the second mounting projections to retain the first mounting projection of the card edge connector in a respective mounting recess of the respective second card edge connector.

13. A card edge connector as recited in claim 9 wherein each terminal has insulation displacement slots provided at the first contact section, whereby multiple wires are terminated to respective insulation displacement slots to allow for special wire schemes.

14. A card edge connector as recited in claim 13 wherein a wire stuffer cap is movable mounted to the housing, the wire stuffer cap is initially provided in an open position, whereby as wires are inserted into the wire stuffer cap, the wire stuffer cap is moved to a second position, forcing the wires into respective insulation displacement slots thereby providing the wires and the terminals in electrical engagement.

15. A card edge connector assembly for electrically connecting wires to contact pads proximate edges of circuit boards, the connector assembly comprising;

at least two electrical connectors, the connectors having housings with first mating faces and second mating faces, terminal receiving cavities extending from proximate the first mating faces toward the second mating faces, board receiving slots extending from the second mating faces toward the first mating faces, the board receiving slots extend from the terminal receiving cavities and extend across more than one terminal receiving cavity, the board receiving slots are dimensioned to receive the edges of circuit boards therein;

terminals positioned in the terminal receiving cavities, the terminals having first contact sections proximate the first mating face and second contact sections;

first mounting projections extending from first sidewalls of the housings and mounting recesses extending from oppositely facing second sidewalls, the mounting projection of one electrical connector is positioned in the mounting recess of a second electrical connector, the first mounting projection and the mounting recess cooperate to maintain the electrical connectors in position relative to each other;

whereby the second contact sections are resiliently displaced as the circuit boards are inserted into the board receiving slots, causing the second contact sections to be biased against contact pads proximate the edges of the circuit boards, providing an electrical engagement between the second contact sections and the contact pads.

16. A card edge connector assembly as recited in claim 15 wherein the first mounting projection of each electrical connector has an upper wall and a lower wall, the upper wall and the lower wall are sloped toward each other as the upper and lower walls near the first sidewall.

17. A card edge connector assembly as recited in claim 16 wherein the mounting recess of each electrical connector has second mounting projections which define the mounting recess, the second mounting projections have sloped walls adjacent the mounting recess, the sloped walls slope away from each other as the sloped walls near the second sidewall.

18. A card edge connector assembly as recited in claim 17 wherein the first mounting projection of first card edge connector is configured to be moved into a mounting recess of a second card edge connector, whereby the upper wall and the lower wall of the first mounting projection of the first card edge connector cooperate with the sloped walls of the second mounting projections of the second card edge connector to retain the first mounting projection of the first card edge connector in a respective mounting recess of the second card edge connector.

19. A card edge connector assembly as recited in claim 15 wherein each terminal has insulation displacement slots provided at the first contact section, whereby multiple wires are terminated to respective insulation displacement slots to allow for respective terminals of the card edge connector assembly to electrically connected to each other through special wire schemes.

* * * * *